US007918060B2

(12) United States Patent
Gobeil

(10) Patent No.: US 7,918,060 B2
(45) Date of Patent: Apr. 5, 2011

(54) UNDER-PLANK FOR WATERTIGHT BALCONY SUB-FLOOR SYSTEM

(76) Inventor: Eric Gobeil, Quebec City (CA)

( * ) Notice: Subject to any disclaimer, the term of this patent is extended or adjusted under 35 U.S.C. 154(b) by 714 days.

(21) Appl. No.: 11/891,839

(22) Filed: Aug. 14, 2007

(65) Prior Publication Data

US 2008/0034672 A1 Feb. 14, 2008

(51) Int. Cl.
*E04B 1/70* (2006.01)
*E04H 12/00* (2006.01)

(52) U.S. Cl. ..... 52/302.3; 52/309.7; 52/478; 52/650.3

(58) Field of Classification Search ..... 52/302.3, 52/309.7, 478, 489.1, 650.3, 715, 309.2, 52/309.16

See application file for complete search history.

(56) References Cited

U.S. PATENT DOCUMENTS

| | | | | |
|---|---|---|---|---|
| 4,065,883 | A * | 1/1978 | Thibodeau | 52/11 |
| 4,860,502 | A * | 8/1989 | Mickelsen et al. | 52/11 |
| 5,052,161 | A * | 10/1991 | Whitacre | 52/385 |
| 5,511,351 | A * | 4/1996 | Moore | 52/302.1 |
| 5,619,832 | A * | 4/1997 | Myrvold | 52/403.1 |
| 6,164,019 | A * | 12/2000 | Salley | 52/11 |
| 6,212,837 | B1 * | 4/2001 | Davis et al. | 52/302.1 |
| 6,244,007 | B1 * | 6/2001 | Heikkila | 52/302.3 |
| 6,415,571 | B2 * | 7/2002 | Risser | 52/302.1 |
| 6,598,353 | B1 * | 7/2003 | Reeves | 52/57 |
| 6,688,059 | B1 * | 2/2004 | Walker | 52/302.3 |
| 6,796,092 | B1 * | 9/2004 | Goebel | 52/302.1 |
| 6,886,302 | B2 * | 5/2005 | Jackson | 52/302.3 |
| 6,918,215 | B2 * | 7/2005 | Smith | 52/177 |
| 7,028,437 | B2 * | 4/2006 | Hauck | 52/302.1 |
| 7,584,580 | B1 * | 9/2009 | Adair et al. | 52/309.1 |
| 2004/0231260 | A1 * | 11/2004 | Burkart | 52/302.1 |
| 2005/0072081 | A1 * | 4/2005 | Goebel | 52/302.1 |
| 2005/0252151 | A1 * | 11/2005 | Kindred | 52/650.3 |
| 2006/0254155 | A1 * | 11/2006 | Koloske | 52/11 |
| 2007/0289232 | A1 * | 12/2007 | Crostic | 52/309.1 |

* cited by examiner

*Primary Examiner* — Richard E Chilcot, Jr.
*Assistant Examiner* — Mark R Wendell

(57) ABSTRACT

The present invention relates to a watertight sub-floor system for balcony or roof, in the form of a semi-rigid rollable plank of corrugated polymeric type installed in juxtaposition to form a waterproof flooring between boards and beams. Under-plank are unwrapped and cut at a desired length to avoid transverse junction with respect to water flow. Under-planks overlap parallel to water flow without loss of sealing. The corrugated under-plank has a design of crests and dips, crests widened and sloping to make possible the receiving of screws from deck board, thereby permitting the descent of water trickling from around the damaging screwing of the under-plank, and dips which bear no perforations from screwing and merely allow water to run off to protect wood structures of patios, balconies or terraces against moisture causing premature rot and to protect objects (bike, mowers . . . ) under a deck.

6 Claims, 5 Drawing Sheets

UNDER-PLANK FOR WATERTIGHT BALCONY SUB-FLOOR SYSTEM

BACKGROUND OF THE INVENTION

This invention relates to the field of sub-floor systems for balcony, patio or terrace of homes and roof.

PRIOR ART

Our research among patents revealed some systems that caught our attention:

CA 1,225,252 is a floor with twin cells to protect electric wire.

CA 2,340,371 is an evacuation drain for plumbing installed within a building.

U.S. Pat. No. 6,539,681 is a spacing for a hollow floor which supports piping for heating or air-conditioning.

EPO JP20000320034 is a sheet looking like a net for preventing infestation of termites.

OBJECTS AND ADVANTAGES

The general objective of this invention is to permit building galleries with openwork planks to shy from rain and snow, for storing objects and protecting a structure against water.

A specific objective is to prevent rainwater from being introduced and remain caught between the boards and the wooden structures which constitute the coating and the braces of a patio or a balcony. This invention allows the draining and the water running off far from the structures composing a patio, a balcony or a terrace.

Another objective is to allow an arrangement under a patio including humps and valleys positioned such that the rainwater will not run any more between the boards so as to maintain dry the lower part of a patio.

BRIEF DESCRIPTION OF DRAWINGS FIGURES

DETAILED DESCRIPTION OF THE PREFERRED EMBODIMENTS

In the following description and in the accompanying drawings, the numeral numbers refer to identical parts in the various Figures.

Figure 1:
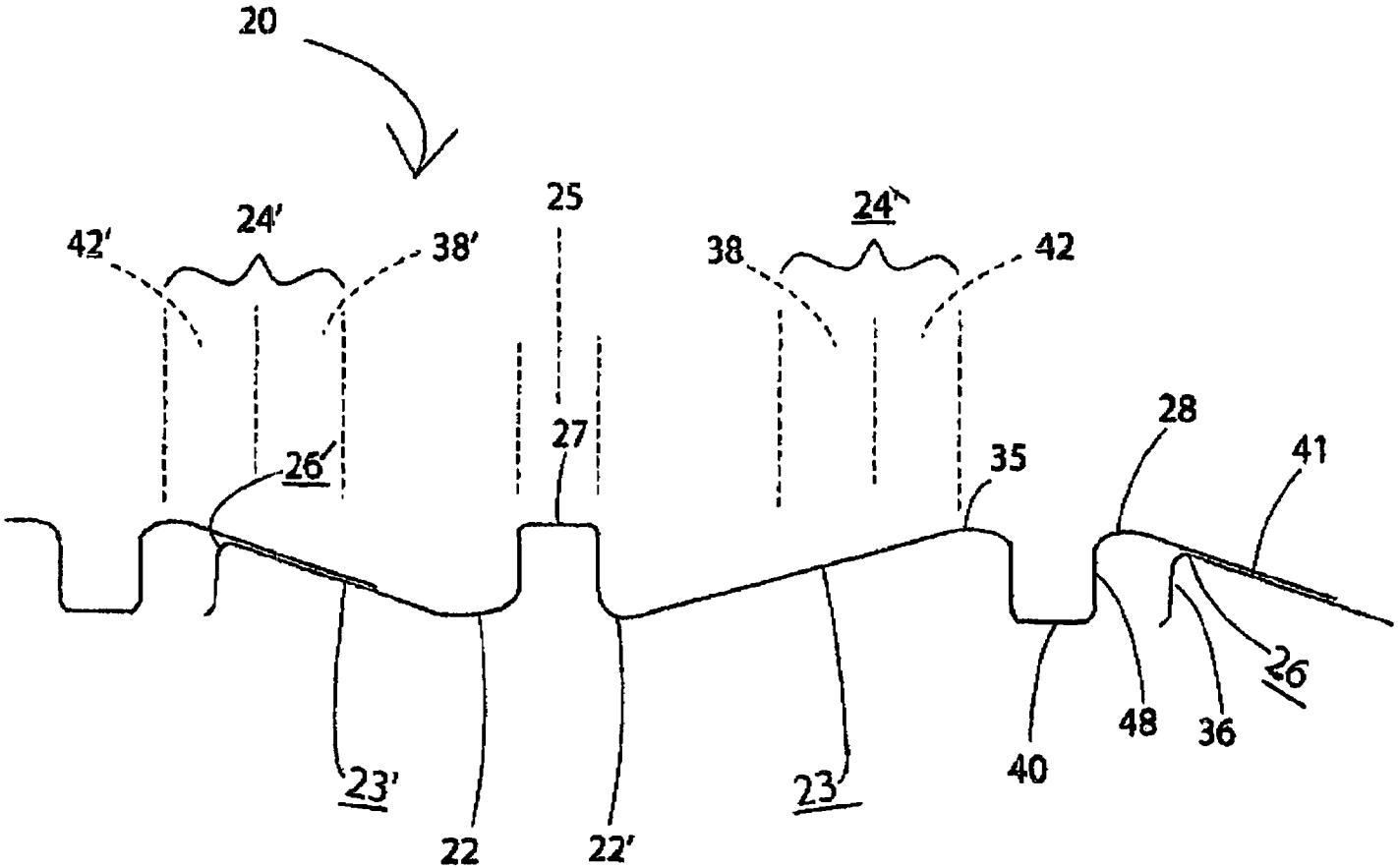
FIG. 1 is a side view of an under-plank

FIG. 1 shows by an arrow a side view of a corrugated under-plank 20. a sloping section 23, 23' surrounded by an accentuated left crest 26, 26' central crest 27 and left crest 35; on which water slips before arriving in the various zones of drainage of water 22, 22'. Zones of screwing 24, 24' correspond to a zone where the screws of a deck hoard will be most effective when piercing the is corrugated under-plank 20, between boards which constitute a coating of a patio and beams. The zones of screwing 24 are defined in widened zones of screwing 38 and abrupt zones of screwing 42. An accentuated crest 26 is encased in a right crest 28 which has an edge 48 of a connection zone 41 in order to allow the connection of a corrugated under-plank 20 to a following one and to maintain the sealing between them. An overlap zone is according to the spacing between boards of patio. A typical variation is 0 to ½ inch. There is a thin zone 25 of screwing on a central crest 27.

Figure 2A:
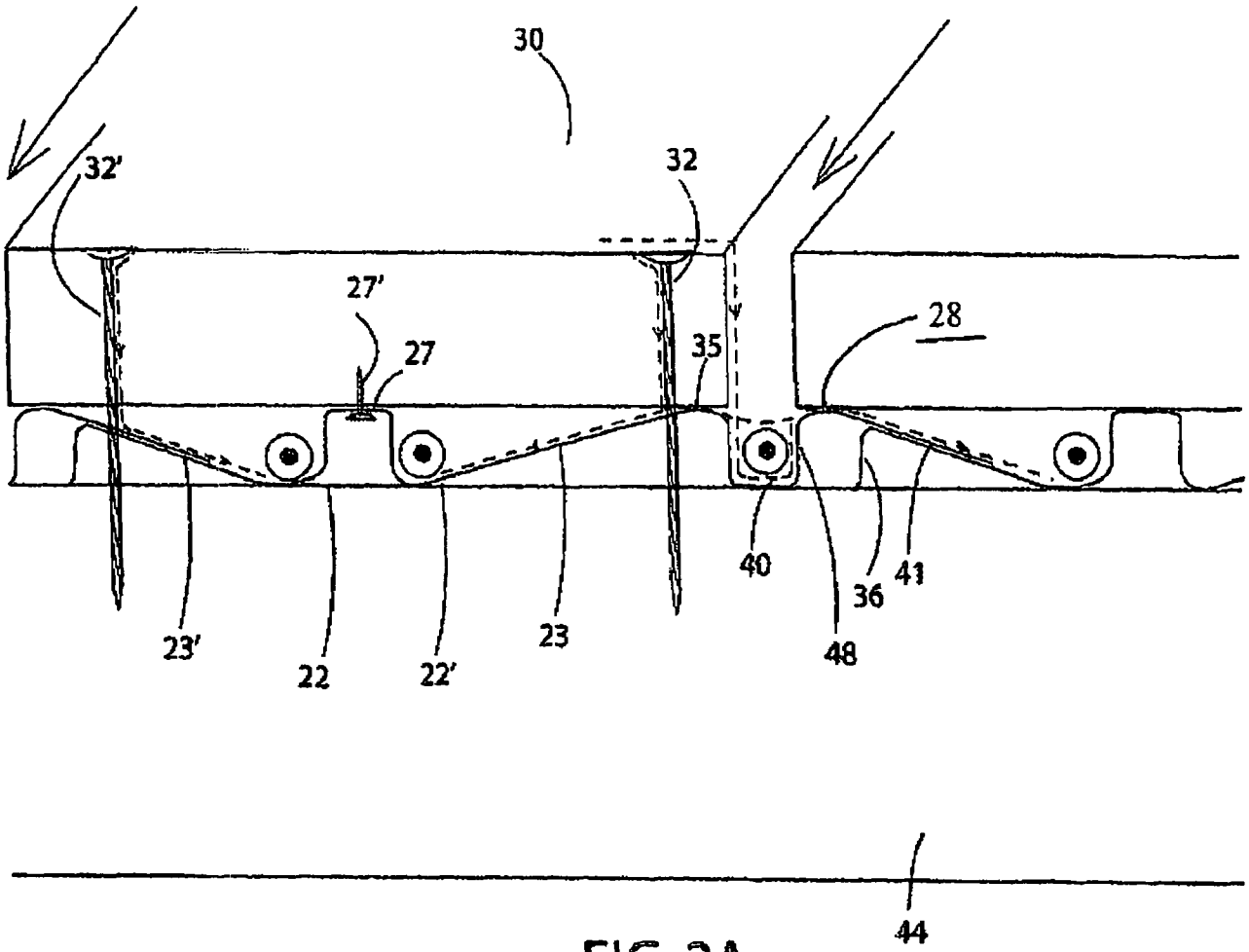
FIGS. 2A and 2B are cut views according to line 2-2 of FIG.4

FIG. 2A Defines water flow direction first vertically along a screw or between two boards then along a slope and finally away from an observer and longitudinally of the board 30. FIG.2A shows a side view of the assembly of a corrugated under-plank 20 maintained in place with screws 32 between wood boards 30 of the coating of the patio and beams 44. Screws 32, 32' are placed close to crests 35 and 26, but preferably in the widened zones of screwing because the water infiltrated through the holes made by screws 32 will run out by slipping below the crests 35 and 28 towards the zones of evacuation 22, 22'. The crest 27 allows screwing from underneath a screw 27' fixed upwardly to retain the corrugated under-plank fixed against the board 30. Water infiltrating through a hole made in a corrugated under-plank 20 runs between the zones of evacuation 22, 22' which are in the direction of the relief of these zones. The dotted arrows show the direction water can follow while running out on or between boards 30 of the covering of the patio before being evacuated by the zones of drainage of water 22, 22'or by the flat bottom 40 of the zone of connection 41.

Figure 2B:
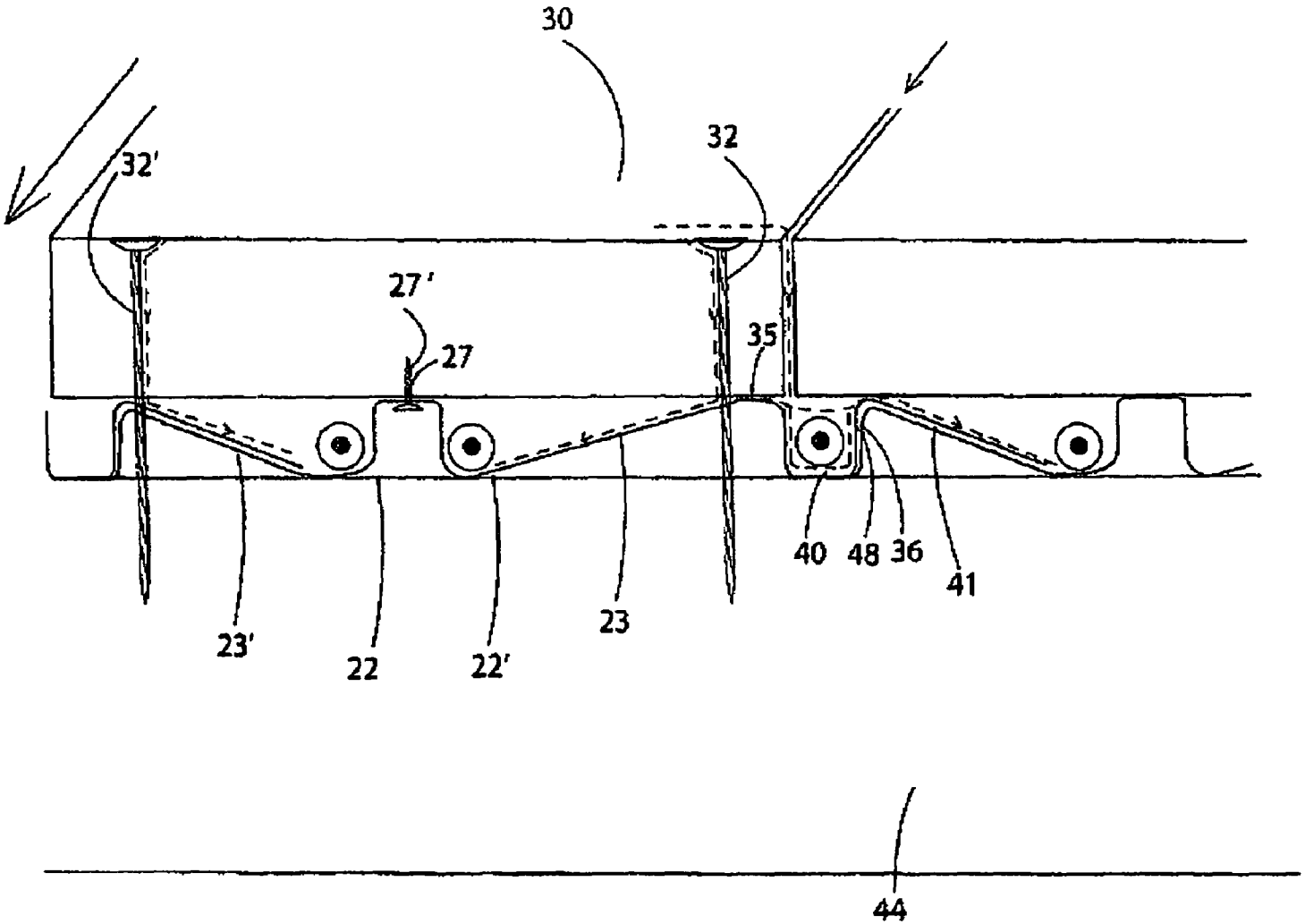

FIG. 2B shows a side view of the assembly of an under-plank 20 wherein boards 30 are closer than those of FIG. 2A to provide adjustment between similar boards 30 laid out on FIG. 2A.

Figure 3A:
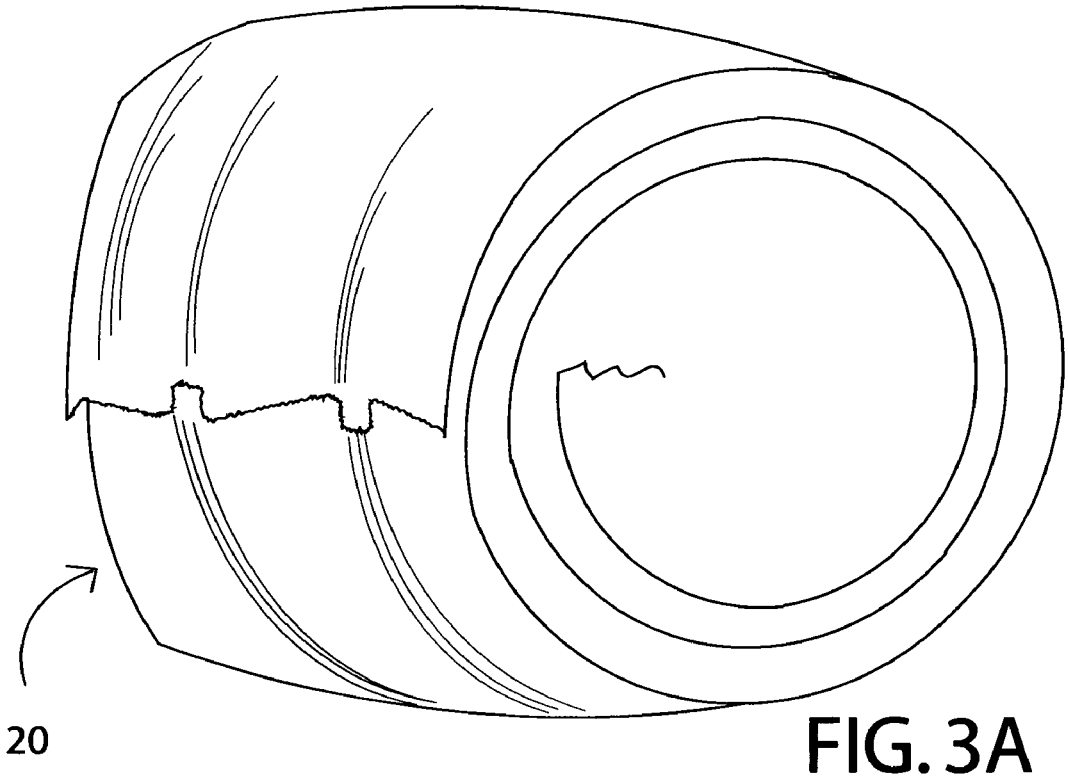
FIG. 3A is a perspective view of an under-plank sheet

FIG. 3A shows an under-plank 20 which is corrugated, an under-plank strip appears rolled over itself several times such as for a glass roll.

Figure 3B:
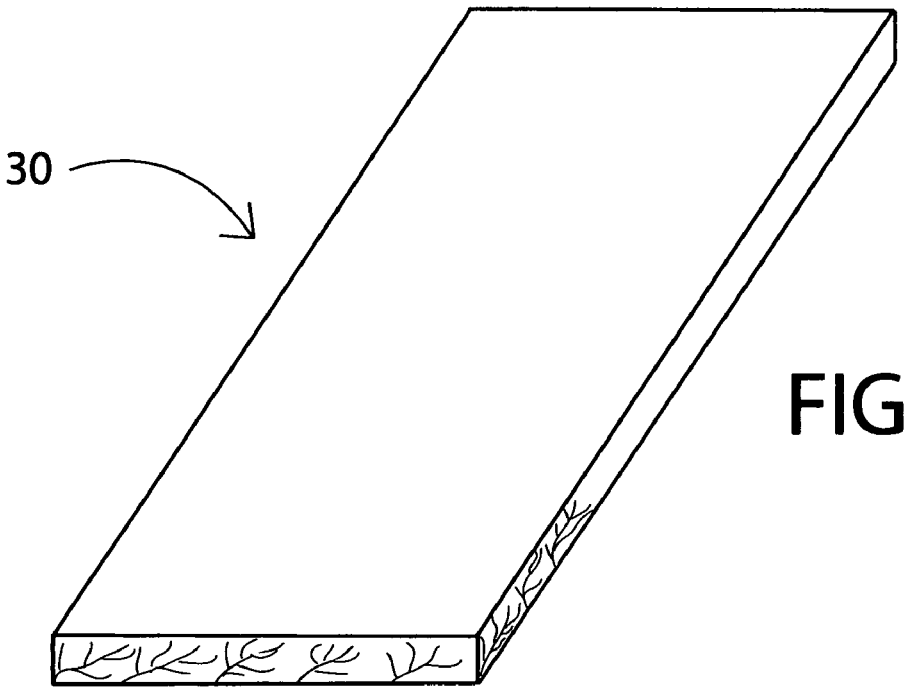
FIG. 3B is a perspective view of a wood board

FIG. 3B shows a deck wood board 30.

Figure 4:
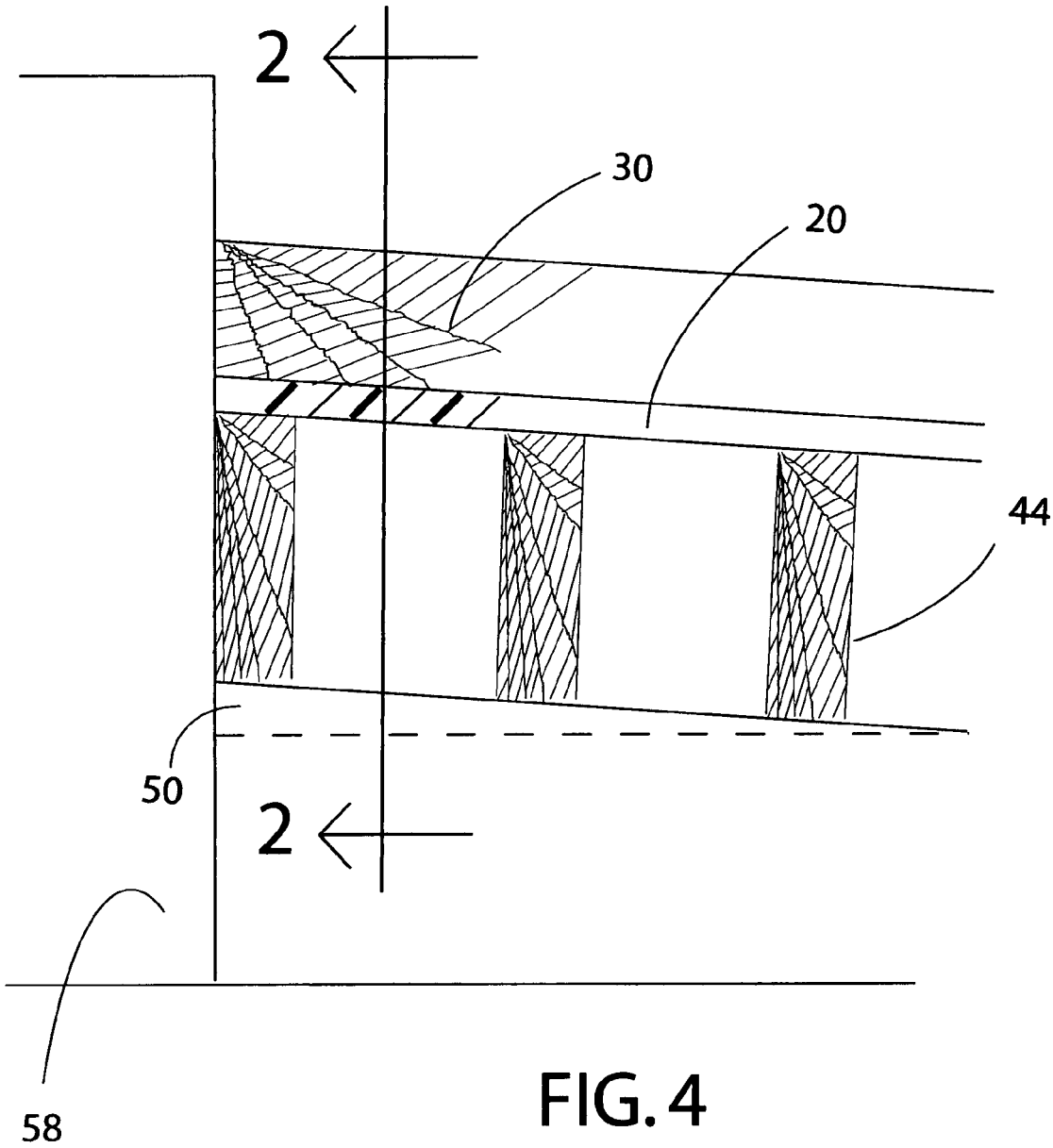
FIG. 4 is a side view of a patio juxtaposed with a building support

FIG. 4 shows a patio 46 juxtaposed at a building 58 with a slope 50 such as ¼ inch per foot in length in order to allow the drainage of water in the direction opposed to that of the building.

Applications The applications of this invention relate to the protection of a patio, a balcony or a terrace deck board; a tight sub-floor for patio is a semi-rigid under-plank of corrugated polymeric installed between beams and transverse boards constituting the covering of the patio. The corrugated under-plank has a design of crests and dips, crests widened to make possible to receive of screws and dips where there will be no perforation of screwing, to allow the water run-off in order to protect the wood structures of patios, balconies or terraces against moisture causing their premature rot.

SUMMARY OF THE INVENTION

A corrugated semi-rigid under-plank intended to be used between a board 30 and a structure element 44, the under-plank having a number of crests 26, 27, 28, 35 among which a group of widened crests 26, 35 intended to provide a spacing to receive screws 32, 32' in a zone of screwing 24, 24', and a flat upper zone 27 of screwing intended to receive a screw 27' fixed upwardly.

The under-plank has a number of dips 22, 22', 40 to provide support over the structure element 44, and to provide means of drainage of a liquid found on a surface of the board 30.

Water infiltrating around screws result in a flow of water along a slope 23, 23' towards the dips 22, 22' called zones of drainage, The under-plank may be placed between two rows of boards, a top row a covering may be a floor, a patio, a balcony, a terrace, or a roof. The under-plank may be placed between two rows of boards, the lower row being beams or foundations of a floor, a patio, a balcony, or a terrace.

The under-plank may be a roof.

The under-plank being corrugated according to the higher and lower crests and whose top and base are all at corresponding height, each crest being a point of support.

The under-plank being sufficiently rigid in order to maintain its form during the screwing and when a significant load will be deposited on it in addition to the people who will circulate and objects which will be deposited on a first rank of boards defined as covering, the form also need to be maintained between the beams in order to preserve the functions of a sub floor.

The under-plank whose zones of drainage of water 22, 22', 40 are intended to provide a means of drainage of rain, water coming from snow melt or water washing accumulating in a natural or artificial way.

The under-plank consisting of an impermeable material to water, the absence of porosity jams the passage of liquid through the under-plank.

The under-plank consisting of a material which does not deteriorate upon moisture, solar radiation and freezing and thaw.

The under-plank is made according to a central axis on in each side of the axis the crests are distributed symmetrically.

The under-plank is formed of crests laid out symmetrically, which implies the disposition according to a regular spacing of boards 30 which constitutes the covering of a patio, in order to allow a screwing in the zones of screwing 24, 24' of the under-plank.

The under-plank whose crests have a sufficient height to allow the flow of water when it rains abundantly.

The under-plank whose lower crests correspond to zones of drainage of water 22, 22'.

The connection zone 41 having a flat dip 40, which is also a zone of drainage, terminated on a terminating edge 48 which matches a forward edge 36 of a second under-plank in order to allow the alignment of several under-plank 20 and the sealing of a sub floor.

The connection zone 41 allowing a variation in the adjustment of the under-planks thereby making possible adjusting boards for the covering of a patio laid out above the flat dip 40 of the connection zone 41.

The under-plank whose higher crests are indicated according to the shape of their slope; accentuated left crests 26, central 27 and the widened crests 35.

The under-plank whose zones of screwing 24, 24' correspond to spaces on both sides of higher crests.

The under-plank whose zones of screwing of the widened crests 26, 35 are indicated according to the extent of the available zone for screwing; widened zone of screwing 38, 38', and the abrupt zone of screwing 42, 42' narrower than the wide zone of screwing.

The under-plank whose widened zones of screwing 38 and the abrupt zones of screwing 42 have a slope of at least 2 degrees which permit water to run out than instead of remain imprisoned between boards 30 of covering and the under-plank 20.

The corrugated under-plank is not necessarily rigid in composition so as to permit the wrapping thereof into a four foot diameter bundle for extension to one hundred feet. The board means may be a coating or a paste or fibreglass spread over the top surface of the under-plank for providing a roof surface without any top board element. The sloping sections may be provided with a clip arrangement to be maintained together. The number of crests 26, 27, 28, 35 and dips 22,22' providing support over structural elements 44, a number of sloping sections 23 to provide a spacing to receive screws 32, 32' in a so-called zone of screwing 24, 24', sloping sections to provide means of drainage of a liquid found on a surface of a board 30 and around the screws, the zone of screwing being limited to the sloping sections, water infiltrating around screws, during screwing and afterwards, resulting in a flow of water towards the dips 22, 22' and resulting in a zone of drainage.

It is to be clearly understood that the instant description with reference to the annexed drawing is made in an indicative manner and that the preferred embodiments described herein are meant in no way to limit further embodiments realizable within the scope of the invention. The matter which is claimed as being inventive and new is limited only by the following claims.

PARTS

20—Under-plank
22—Zone of drainage of water
23, 23'—Sloping sections
24—Zone of screwing
25—Thin zone of screwing
26, 26'—Left accentuated Crests
27—Central crest
27'—Screw fixed upwardly
28—Right Crest
30—Board
32—Screw
35—Left Crest
36—Forward edge
38—Widened Zone of screwing
40—Flat bottom of the connection zone 41
41—Connection zone
42—Abrupt Zone of screwing
44—Structural element
46—Patio
48—Terminating edge
50—Slope
52—Beam
54—Support
58—Support building

I claim:

1. A combination of a corrugated under-plank used between a board and a structure element and comprising:

a rigid film having at least three crests and two dips to provide support over said structural element, at least two sloping sections, a spacing to receive screws between said crests and said dips, said sloping sections providing means of drainage when a liquid is found around said screws, said rigid film comprising a connection zone having a flat dip terminated on a terminating edge which matches a forward edge of a second under-plank in order to allow a variation of spacing between one under-plank and the next one, said variation being equal to the variation of spacing between two boards, said connection zone making possible adjusting boards for the covering of a patio laid out above said connection zone.

2. The under-plank of claim 1 wherein said connection zone is located below said board to avoid receiving matter directly from a spacing between a board and a neighbouring one.

3. The under-plank of claim 1 wherein said crests are positioned under a board in areas for supporting said board while initiating a slope, defining accentuated left crests, central, right and left crests and a flat bottom, said spacing to receive said screws corresponding to spaces on both sides of left and right crests indicated according as a zone available for screwing comprising a widened zone of screwing and an abrupt zone of screwing being narrower than said widened zone of screwing.

4. The under-plank of claim 3 wherein said widened zones of screwing and said abrupt zones of screwing have a slope of at least 2 degrees which permit water to run out instead of remaining imprisoned between boards of an under-plank.

5. The under-plank of claim 3 being part of a number of under-planks installed on beams to support said right and left crests while being moulded according to the shape of said crests.

6. The under-plank of claim 5 wherein said number of under-planks are continuous.

* * * * *